US007571769B2

(12) United States Patent
Soni et al.

(10) Patent No.: US 7,571,769 B2
(45) Date of Patent: Aug. 11, 2009

(54) CASING WINDOW MILLING ASSEMBLY

(75) Inventors: Mohan L. Soni, Katy, TX (US); Calvin J. Stowe, II, Bellaire, TX (US)

(73) Assignee: Baker Hughes Incorporated, Houston, TX (US)

( * ) Notice: Subject to any disclaimer, the term of this patent is extended or adjusted under 35 U.S.C. 154(b) by 159 days.

(21) Appl. No.: 11/710,161

(22) Filed: Feb. 23, 2007

(65) Prior Publication Data

US 2008/0202754 A1 Aug. 28, 2008

(51) Int. Cl.
*E21B 29/06* (2006.01)

(52) U.S. Cl. ..... 166/298; 166/55

(58) Field of Classification Search ..... 166/298, 166/55, 55.7; 175/61, 79–82, 406
See application file for complete search history.

(56) References Cited

U.S. PATENT DOCUMENTS

| | | | | |
|---|---|---|---|---|
| 4,131,167 | A | 12/1978 | Richey | |
| 4,258,804 | A | 3/1981 | Richey et al. | |
| 4,600,063 | A | 7/1986 | Beasley | |
| 4,630,690 | A | 12/1986 | Beasley et al. | |
| 4,729,438 | A | 3/1988 | Walker et al. | |
| 4,974,691 | A | 12/1990 | Leaney et al. | |
| 5,033,558 | A | 7/1991 | Russo et al. | |
| 5,332,048 | A | 7/1994 | Underwood et al. | |
| 5,538,091 | A | 7/1996 | Theocharopoulos | |
| 5,603,386 | A | 2/1997 | Webster | |
| 5,758,723 | A | 6/1998 | Saucier et al. | |
| 5,836,406 | A | 11/1998 | Schuh | |
| 5,931,239 | A | 8/1999 | Schuh | |
| 6,209,645 | B1 | 4/2001 | Ohmer | |
| 6,267,179 | B1 * | 7/2001 | Ohmer et al. | 166/298 |
| 6,296,066 | B1 | 10/2001 | Terry et al. | |
| 6,302,198 | B1 * | 10/2001 | Ritorto et al. | 166/55.1 |
| 6,488,090 | B1 | 12/2002 | Ohmer | |
| 2002/0007970 | A1 | 1/2002 | Terry et al. | |
| 2002/0144815 | A1 | 10/2002 | Van Drentham-Susman et al. | |
| 2005/0257930 | A1 * | 11/2005 | Carter et al. | 166/298 |

FOREIGN PATENT DOCUMENTS

| | | |
|---|---|---|
| EP | 0 254 900 B1 | 4/1990 |
| WO | WO 93/25794 | 12/1993 |

* cited by examiner

*Primary Examiner*—Hoang Dang
(74) *Attorney, Agent, or Firm*—Greenberg Traurig LLP; Anthony F. Matheny

(57) ABSTRACT

Casing window milling assemblies include a conically-shaped section disposed along the tubular of the assembly. This conically-shaped section is a non-cutting portion that is preferably tapered toward the mill head. The conically-shaped section may be part of a flex-joint section of the assembly. Alternatively, the conically-shaped section may be its own sub-assembly secured above the flex-joint. In still another embodiment, the conically-shaped tapered section may be part of the upper mill section of the casing window milling assembly. In one embodiment, the conically-shaped section is disposed along the upper mill section below one or more secondary mills such as a reaming mill and a honing mill.

26 Claims, 5 Drawing Sheets

CASING WINDOW MILLING ASSEMBLY

BACKGROUND

1. Field of Invention

The invention is directed to devices for milling a window in casing disposed in an oil or gas wellbore and, in particular, to casing window milling assemblies for cutting a window in the wellbore casing such as for allowing a lateral, offshoot, horizontal, or branch wellbore to be drilled.

2. Description of Art

Casing window milling assemblies for use with whipstocks disposed within wellbore casing are known in the art. These assemblies operate by lowering the assembly into a wellbore casing until a cutting end, or mill head, contacts the whipstock. As the assembly is further lowered, the mill head is forced into the wellbore casing by the whipstock. As a result, the mill head begins cutting the wellbore casing to form a window.

Contemporaneously, two additional, or secondary, mills such as a reaming mill and a honing mill begin cutting the wellbore casing above the window formed by the mill head. As the mill head moves further downhole, and is further forced into the wellbore casing by the whipstock, the opening being formed by the reaming mill and the honing mill gradually move toward the window formed by the mill head until the opening and the window connect. To assist with the bending moment caused by the mill head being forced by the whipstock into the wellbore casing, a flex-joint is usually disposed above the mill head.

As illustrated in FIG. 1, a typical prior art casing window milling assembly 10 contains three portions: mill head 12, flex-joint 14, and upper mill section 16. Upper mill section 16 includes secondary mills referred to as reaming mill 17 and honing mill 18. As mentioned above, flex-joint 14 allows assembly 10 to bend slightly as it is lowered down the wellbore casing (not shown) and mill head 12 contacts a whipstock (not shown) so that assembly 10 can be properly oriented with respect to the wellbore casing during milling operations.

Although these prior assemblies are effective at ultimately forming the desired opening in the wellbore casing, they have several shortcomings. For example, in casing window milling assemblies in which the reaming mill 17 and honing mill 18 are disposed toward the upper end of the assembly, i.e., toward the end opposite the end having the mill head 12, the reaming mill and honing mill routinely engage the wellbore casing prematurely causing the reaming mill and honing mill to lose their milling ability prematurely. As a result, the length of casing window above and near the top of the whipstock is reduced such that longer and larger diameter assemblies and other equipment which, in most cases, are more desirable, cannot pass through the opening.

Current casing window milling assemblies also experience problems with the mill head wearing out prematurely. As discussed above, the mill head cuts the wellbore casing at the same time the reaming mill and honing mill cut the casing. The three mills cutting at the same time excites severe vibration of the mills against the casing. This vibration impact can cause the cutters to breakdown and the mills loose their cutting ability prematurely. This can lead to the considerable expense of a second milling operation with a fresh set of mills.

Another shortcoming of the current window milling assemblies is that the mill head prematurely exits the casing producing a shorter window (more deviated wellpath) which may adversely affect the subsequent drilling or other wellbore operations. To cut a required length window it is essential that the mill head be kept in substantial contact with the whipstock until it nears the end of the whipstock ramp or scoop. The current milling assemblies attempt to achieve this by using the upper mill and high side of the casing contact as a fulcrum. But since either the upper mills and the casing are worn out or the casing is cut away as described in the preceding paragraphs, the constraint at the fulcrum is either relaxed or completely lost resulting in a side force which is often inadequate causing the mill head to drill away from the whipstock prematurely producing a reduced length window.

Accordingly, prior to the development of the present invention, there has been no casing window milling assembly or method of cutting an opening in a wellbore casing that: prevents the reaming mill and honing mill from prematurely engaging the wellbore casing; decreases the torque exerted on the casing window milling assembly; increases the life of the mills by decreasing vibration of the casing window milling assembly; and provides the side force need to prevent the mill head from drilling away from the whipstock before the desired opening length is achieved. Therefore, the art has sought a casing window milling assembly and a method of cutting an opening in a wellbore casing that: prevent the reaming mill and honing mill from prematurely engaging the wellbore casing; decrease the torque exerted on the casing window milling assembly; increase the life of the mills by decreasing vibration of the casing window milling assembly; and provide the side force need to prevent the mill head from drilling away from the whipstock before the desired opening length is achieved.

SUMMARY OF INVENTION

The casing window milling assemblies disclosed herein include a conically-shaped tapered section disposed between the mill head and a reaming mill and a honing mill disposed on an upper mill section. This conically-shaped tapered section is a non-cutting portion that is preferably tapered toward the mill head. The conically-shaped tapered section also preferably is formed by, or includes attached thereto, a hardfacing or other low friction or wear-reducing surface such as aluminum bronze or tungsten carbide. The conically-shaped section may be part of the flex-joint of the assembly. Alternatively, the conically-shaped section may be its own subassembly secured above the flex-joint and below the upper mill section of the casing window milling assembly that contains the reaming mill and honing mill. In still another embodiment, the conically-shaped section may be part of the upper mill section of the casing window milling assembly. In a particularly preferred embodiment, the conically-shaped section is disposed along the upper mill section below the reaming mill and the honing mill.

The casing window milling assembly and method of cutting an opening in a wellbore casing disclosed herein have one or more of the advantages of: preventing the reaming mill and honing mill from prematurely engaging the wellbore casing; decreasing the torque exerted on the casing window milling assembly; increasing the life of the mills by decreasing vibration of the casing window milling assembly; and providing the side force need to prevent the mill head from drilling away from the whipstock before the desired opening length is achieved.

In one aspect, one or more of the foregoing advantages may be achieved through an improved casing window milling assembly having a tubular and a mill head disposed at a lower end of the tubular in which the improvement comprises a conically shaped section of the tubular that is tapered toward the mill head.

A further feature of the improved casing window milling assembly is that the conically shaped section of the tubular may be at least twice as long as a largest outer diameter of the conically shaped section. Another feature of the improved casing window milling assembly is that the assembly may further comprise a whipstock having a whipstock taper angle and wherein the conically shaped section has a taper angle that is equal to one-half of the whipstock taper angle. An additional feature of the improved casing window milling assembly is that the assembly may further comprise a flex portion between the conically shaped section and the mill head. Still another feature of the improved casing window milling assembly is that the conically shaped section may be formed of a material having a hardness greater than the tubular. A further feature of the improved casing window milling assembly is that the conically shaped section may comprise a layer of hardfacing that is wear resistant, but not abrasive. Another feature of the improved casing window milling assembly is that the assembly may further comprise a secondary mill and the conically shaped section is disposed between the mill head and the secondary mill.

In another aspect, one or more of the foregoing advantages may be achieved through a casing window milling assembly in which the assembly comprises a mill head having a mill housing, a cutting end, a mill head upper end, and mill head bore longitudinally disposed within the mill housing; a flex-joint having a flex-joint tubular, a flex-joint lower end connected to the mill head upper end, a flex-joint upper end, and a flex-joint bore longitudinally disposed within the flex-joint tubular and in fluid communication with the mill head bore, wherein at least a portion of the flex-joint tubular is a conically shaped section that is tapered toward the mill head; and an upper mill having an upper mill tubular, an upper mill lower end connected to the flex-joint upper end, an upper mill upper end, an upper mill bore longitudinally disposed within the upper mill tubular and in fluid communication with the flex-joint bore, and at least one secondary upper mill disposed along the upper mill tubular.

A further feature of the casing window milling assembly is that the conically shaped section of the flex-joint tubular may be disposed proximate to the flex-joint upper end. Another feature of the casing window milling assembly is that the conically shaped section of the flex-joint tubular may be at least twice as long as a largest outer diameter of the flex-joint tubular. An additional feature of the casing window milling assembly is that the flex-joint may have a length and the conically shaped section of the flex-joint tubular may have a conically shaped section length that is at least one third of the length of the flex-joint. Still another feature of the casing window milling assembly is that the conically shaped section of the flex-joint tubular may be formed from a material selected from the group consisting of aluminum bronze, tungsten carbide, or hardfacing. A further feature of the casing window milling assembly is that the conically shaped section of the flex-joint tubular may include an outer layer formed from a material selected from the group consisting of aluminum bronze, tungsten carbide, or hardfacing.

In an additional aspect, one or more of the foregoing advantages may be achieved through a casing window milling assembly in which the assembly comprises a mill head having a mill housing, a cutting end, a mill head upper end, and mill head bore longitudinally disposed within the mill housing; a flex-joint having a flex-joint tubular, a flex-joint lower end connected to the mill head upper end, a flex-joint upper end, and a flex-joint bore longitudinally disposed within the flex-joint tubular and in fluid communication with the mill head bore; and an upper mill having an upper mill tubular, an upper mill lower end connected to the flex-joint upper end, an upper mill upper end, an upper mill bore longitudinally disposed within the upper mill tubular and in fluid communication with the flex-joint bore, and at least one secondary upper mill disposed along the upper mill tubular, wherein at least a portion of the upper mill tubular is a conically shaped section that is tapered toward the mill head.

A further feature of the casing window milling assembly is that at least one of the at least one secondary upper mills may be disposed above the conically shaped section of the upper mill tubular. Another feature of the casing window milling assembly is that the upper mill tubular may include two secondary upper mills, both of the secondary upper mills being disposed above the conically shaped section of the upper mill tubular. An additional feature of the casing window milling assembly is that the conically shaped section of the upper mill may be disposed proximate to the upper mill lower end. Still another feature of the casing window milling assembly is that the conically shaped section of the upper mill tubular may be formed from a material selected from the group consisting of aluminum bronze, tungsten carbide, or hardfacing. A further feature of the casing window milling assembly is that the conically shaped section of the upper mill tubular may include an outer layer formed from a material selected from the group consisting of aluminum bronze, tungsten carbide, or hardfacing.

In yet another aspect, one or more of the foregoing advantages may be achieved through a casing window milling assembly in which the assembly casing window comprises a mill head having a mill housing, a cutting end, a mill head upper end, and mill head bore longitudinally disposed within the mill housing; a flex-joint having a flex-joint tubular, a flex-joint lower end connected to the mill head upper end, a flex-joint upper end, and a flex-joint bore longitudinally disposed within the flex-joint tubular and in fluid communication with the mill head bore; a tapered sub having a tapered sub tubular, a tapered sub lower end connected to the flex-joint upper end, a tapered sub upper end, and a tapered sub bore longitudinally disposed within the tapered sub tubular, wherein at least a portion of the tapered sub tubular is a conically shaped section that is tapered toward the mill head; and an upper mill having an upper mill tubular, an upper mill lower end connected to the tapered sub upper end, an upper mill upper end, an upper mill bore longitudinally disposed within the upper mill tubular and in fluid communication with the tapered sub bore, and at least one secondary upper mill disposed along the upper mill tubular.

A further feature of the casing window milling assembly is that the conically shaped section of the tapered sub may constitute a majority of the length of the tapered sub. Another feature of the casing window milling assembly is that the conically shaped section of the tapered sub tubular may be at least twice as long as a length of the mill head as measured from a lower most point of the cutting end to an upper most point of the mill tubular. An additional feature of the casing window milling assembly is that the conically shaped section of the tapered sub tubular may be formed from a material selected from the group consisting of aluminum bronze, tungsten carbide, or hardfacing. Still another feature of the casing window milling assembly is that the conically shaped section of the tapered sub tubular may include an outer layer formed from a material selected from the group consisting of aluminum bronze, tungsten carbide, or hard facing.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
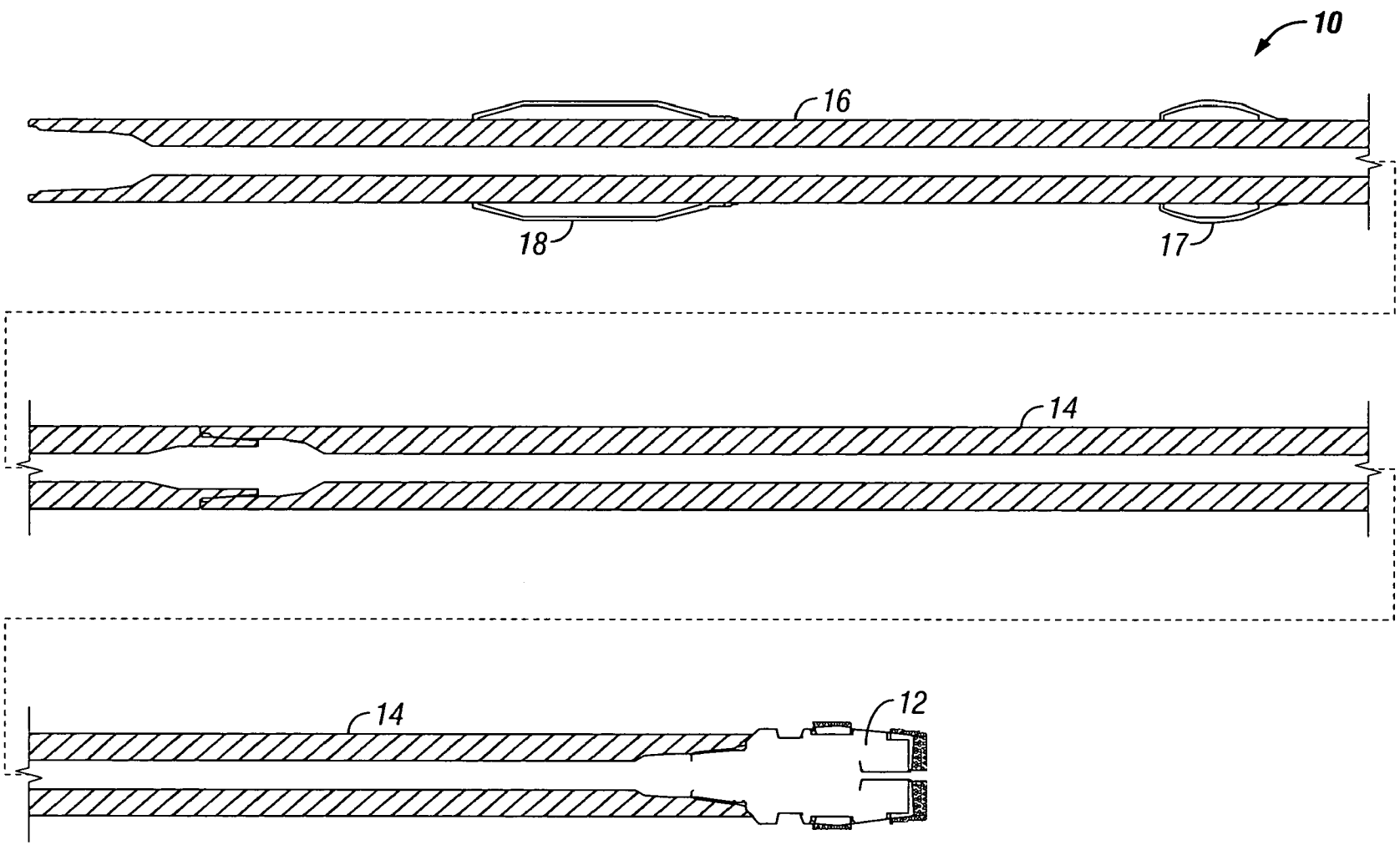
FIG. 1 (Prior Art)
FIG. 1 is a cross-sectional view of a prior art casing window milling assembly.
Figure 2A:
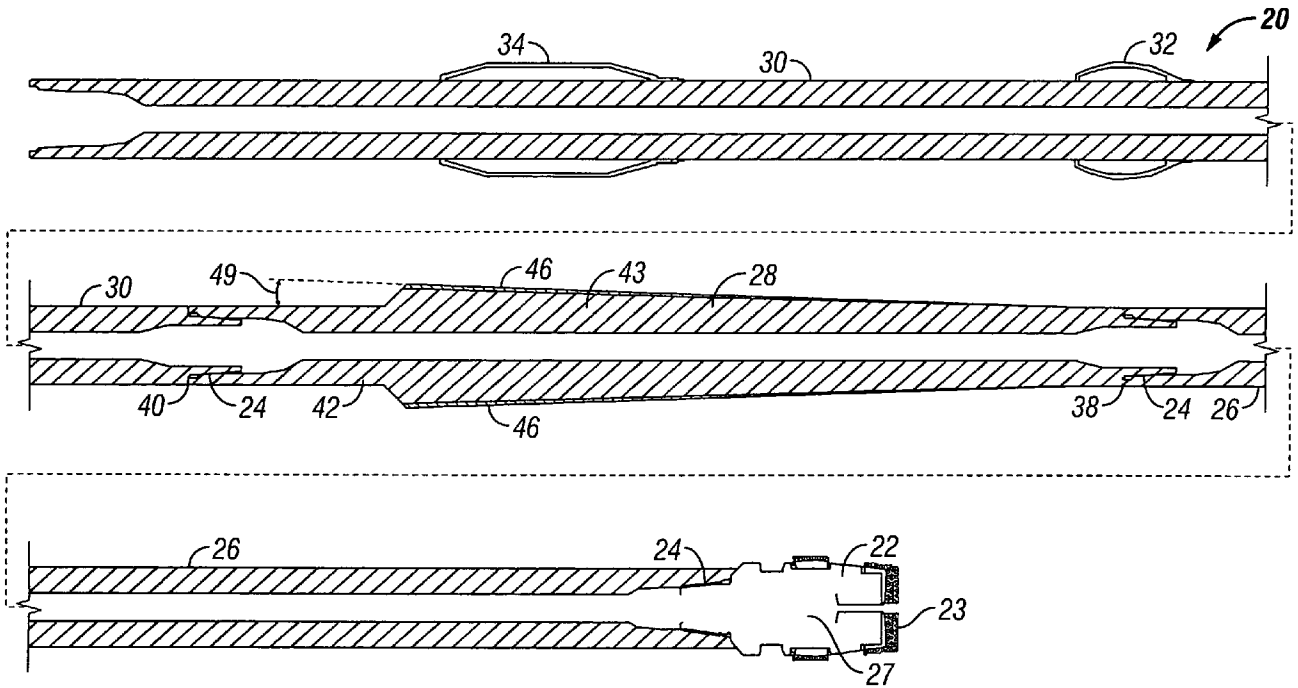
FIG. 2 is a cross-sectional view of one specific embodiment of the casing window milling assembly and a whipstock disclosed herein.
Figure 2B:
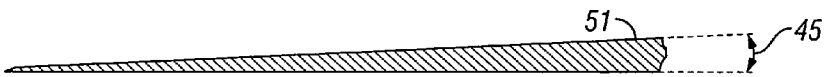
Figure 3:
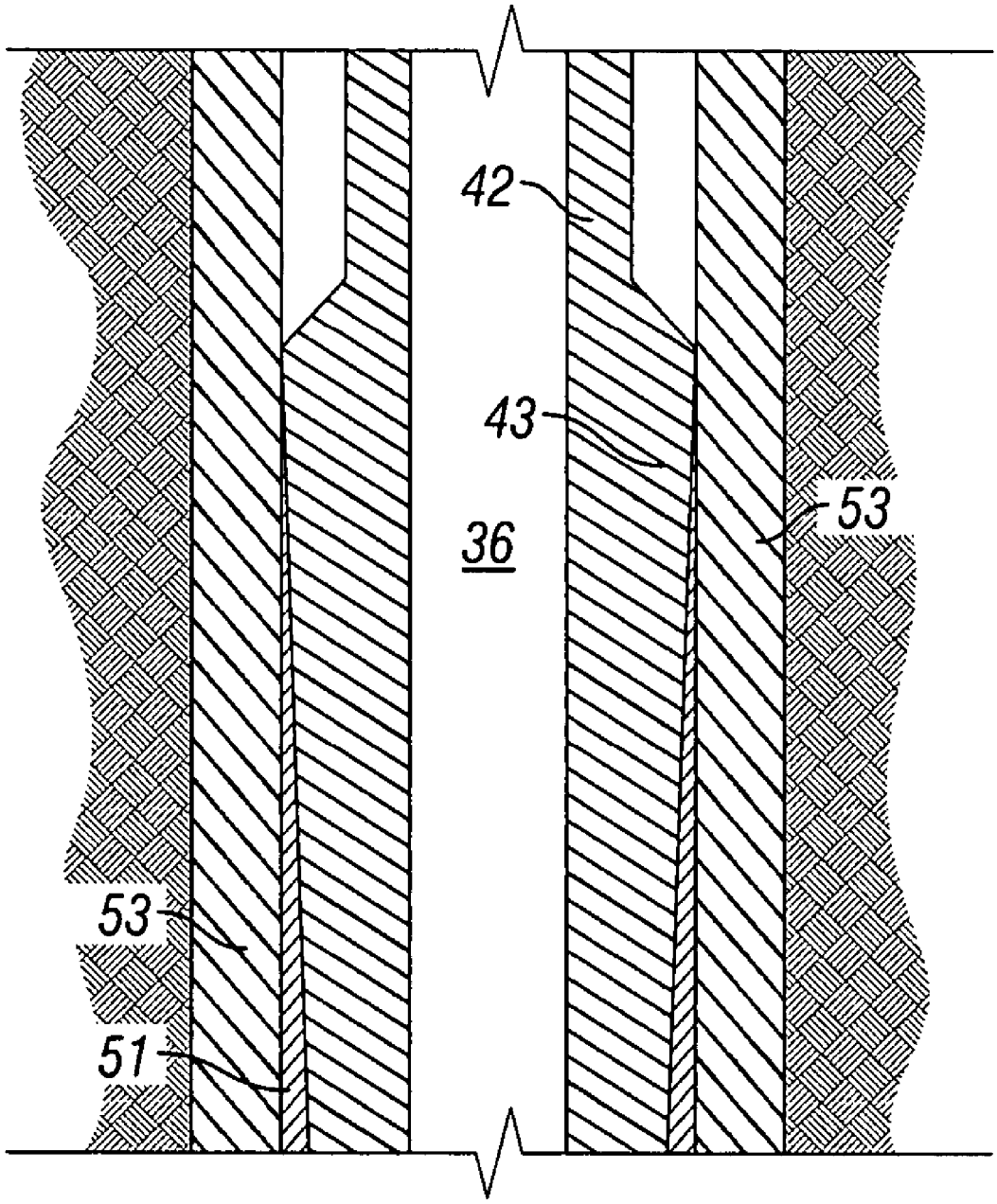
FIG. 3 is an enlarged cross-sectional view of the assembly shown in FIG. 2 shown in engagement with the borehole casing in a cased well.

Referring now to FIGS. 2-3, in one specific embodiment, casing window milling assembly 20 includes mill head 22 secured, such as through threads 24, to flex-joint 26. Mill head 22 includes lower end 23 and mill head housing or body 27. Flex-joint 26 is secured, such as through threads 24, to tapered sub 28, which is secured, such as through threads 24, to upper mill 30. Upper mill 30 includes one or both of the secondary mills referred to as reaming mill 32 and honing mill 34. As shown in this embodiment, tapered sub 28 is disposed between mill head 22 and reaming mill 32 and honing mill 34. Bore 36 is longitudinally disposed through mill head 22, flex-joint 26, tapered sub 28, and upper mill 30.

Tapered sub 28 includes lower end 38, upper end 40, and tubular 42. Tubular 42 has conical section 43 that has a variable outer diameter such that conical section 43 is at least partially conically-shaped. The smaller outer diameter of conical section 43 is disposed proximate to lower end 38 of tapered sub 28 and the larger outer diameter of conical section 43 is disposed proximate to upper end 40 of tapered sub 28. Angle 45 between the upper end and lower end of conical section 43 is preferably equal to tapered angle 49 of whipstock 51. Therefore, as shown in FIG. 3, conical section 43 contacts and moves down whipstock 51 such that conical section 43 and, thus, tubular 42 stay in contact with whipstock 51 and the inner wall surface of the wellbore casing 53 over substantially the entire length of conical section 43.

In another embodiment, angle 45 of conical section 43 is approximately one-half of tapered angle 49 of whipstock 51 such that the upper end of conical section 43 can contact one or both whipstock 51 and the inner wall surface of casing 53 throughout the milling operation. It is to be understood that the length of conical shaped section 43, size of angle 45 of conical shaped section 43, and the profile of conical section 43 may be altered as needed for specific applications based upon the required side force distribution versus the position of mill head 22 along the ramp or scoop of whipstock 51.

Preferably, a majority of the length of tapered sub 28 is conically shaped, thereby providing prolonged contact of tapered sub 28 with the inner wall surface of the wellbore casing (partially shown in FIG. 3) so that the secondary mill or secondary mills do not engage and begin cutting the casing until they are approximately four feet above the whipstock 51. In other words, conical section 43 forms a majority of the length of tubular 42 and, thus, tapered sub 28. In a particularly preferred embodiment, the length of conical section 43 is at least two times the largest outer diameter of conical section 43. The outer diameter at the lower end of conical section 43 is approximately equal to the outer diameter of mill head 22. Further, the length of conical section 43 is preferably at least two times the length of any secondary mill, e.g., reaming mill 32 and honing mill 34.

Tubular 42 and, thus conical section 43, may be formed out of any material known to persons of ordinary skill in the art. Preferably, suitable conical section 43 is formed out of a material that is wear-resistant such that conical section 43 is not easily worn down by contact with the inner wall surface of wellbore casing 53 (FIG. 3). In specific embodiments, conical section 43 comprises an outer coating or layer 46 of hardened material, such as aluminum bronze, tungsten carbide or hardfacing, to reduce wear along the outer surface of conical section 43 during milling of a window in the wellbore casing. Alternatively, conical section 43 could be homogeneous material machined to form tubular 42 having a conically shaped exterior. In a preferred embodiment, conical section 43 comprises layer 46 of aluminum bronze, tungsten carbide or hardfacing is applied to the outer surface of conical section 43. Layer 46 can be applied to the cylindrical outer diameter of tubular 42 in such a way that the upper end of layer 46 is thicker than the lower end of layer 46 so that conical section 43 is formed by the application of layer 46 to tubular 42. In another specific embodiment, conical section 43 could be a tubular sleeve of a more wear resistant material than tubular 42, flex-joint 26, or upper mill 30. The tubular sleeve is the disposed around cylindrical tubular 42, flex-joint 26, or upper mill 30.

Although the outer surface of conical section 43 may include one or more layers 46 to reduce wear of conical section 43, it is to be understood that conical section 43 is not abrasive as it is not intended to cut or abrade, or otherwise provide any milling of, the wellbore casing. To the contrary, conical section 43 is a non-cutting portion of casing window milling assembly 20.

Figure 4:
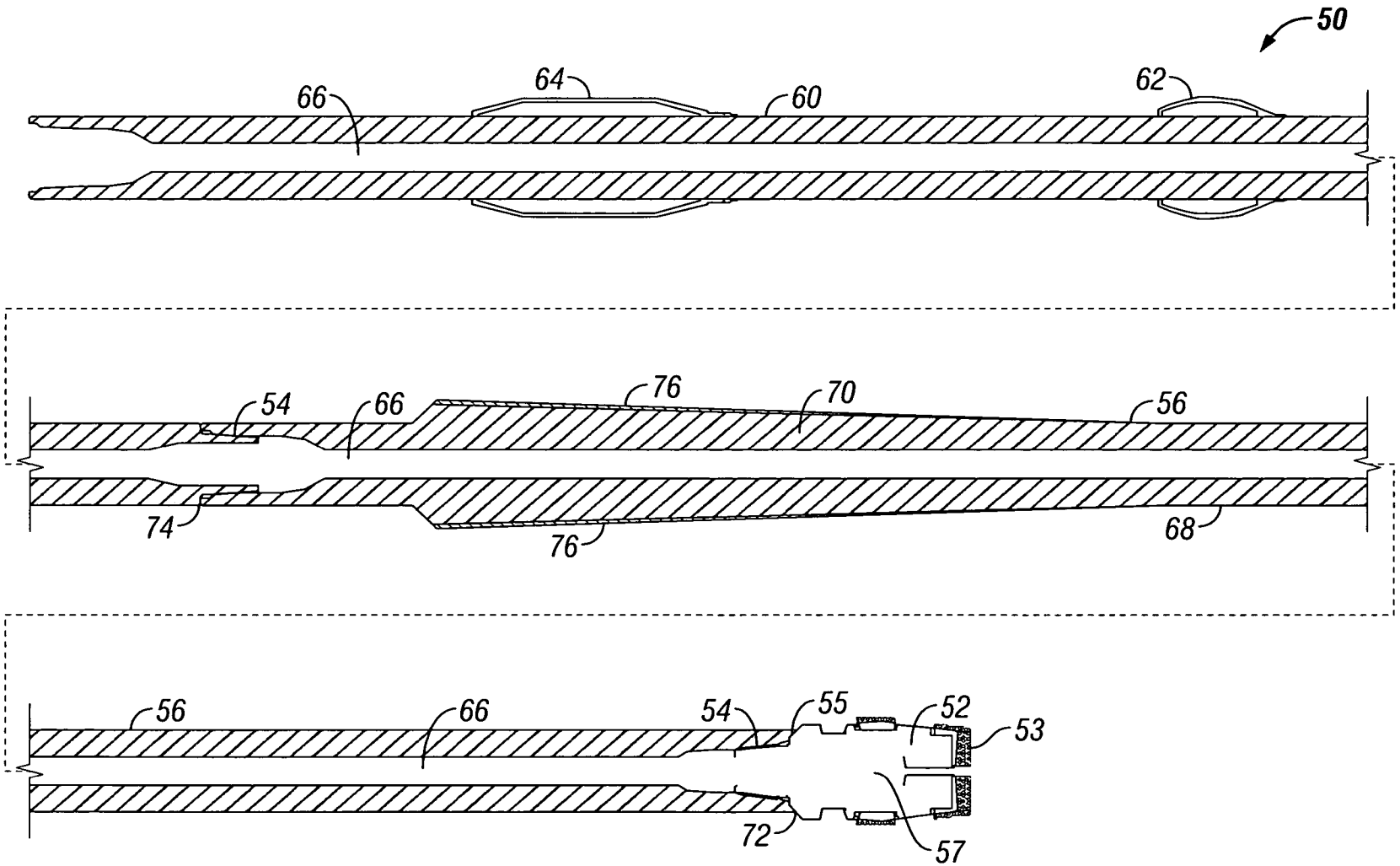
FIG. 4 is a cross-sectional view of another specific embodiment of the casing window milling assembly disclosed herein.

As illustrated in FIG. 4, in another specific embodiment casing window milling assembly 50 includes mill head 52 secured, such as through threads 54, to flex-joint 56. Flex-joint 56 is secured, such as through threads 54, to upper mill 60. Upper mill 60 includes one or both of reaming mill 62 and honing mill 64. Bore 66 is longitudinally disposed through mill head 52, flex-joint 56, and upper mill 60.

In this embodiment, conical section 70 is an integral part of an upper portion of flex-joint 56, rather than a separate sub-assembly component like tapered sub 28. Conical section 70 of flex-joint 56 is disposed along a length of tubular 68 between mill head 52 and upper mill 60 and, thus, reaming mill 62 and honing mill 64.

Conical section 70 has a variable outer diameter, such that conical section 70 and, thus, tubular 68, is at least partially conically-shaped. The smaller outer diameter of conical section 70 is disposed proximate to lower end 72 of flex-joint 56 and the larger outer diameter of conical section 70 is disposed proximate to upper end 74 of flex-joint 56. Preferably, conical section 70 is disposed closer to upper end 74 than to lower end 72. Also preferably, the length of conical section 70, i.e., the conically shaped section of tubular 68, is at least one-third the total length of flex-joint 56, thereby providing prolonged contact of conical section 70 with the inner wall surface of the wellbore casing (not shown). In a particularly preferred embodiment, the length of conical section 70 that is conically shaped is at least two times the length of mill head 52, where mill head 52 is measured from its lower end 53 to the top 55 of mill head housing or body 57, i.e. at the bottom of threads 54. The length and variable diameters of conical section 70 may also include any of the dimensions discussed above with respect to the embodiment shown in FIGS. 2-3.

Tubular 68 and, thus conical section 70, may be formed out of any material known to persons of ordinary skill in the art. Preferably, suitable conical section 70 is formed out of a material that is wear-resistant such that conical section 70 is not easily worn down by contact with the inner wall surface of the wellbore casing. In specific embodiments, conical section 70 comprises an outer coating or layer 76 of hardened material, such as aluminum bronze, tungsten carbide or hardfacing, to reduce wear along the outer surface of conical section 70 during milling of a window in the wellbore casing. Alternatively, conical section 70 could be homogeneous material machined to form tubular 68 having a conically shaped exterior. In a preferred embodiment, conical section 70 comprises layer 76 of aluminum bronze, tungsten carbide or hardfacing is applied to the outer surface of conical section 70. Layer 76 can be applied to the cylindrical outer diameter of tubular 68 in such a way that the upper end of layer 76 is thicker than the lower end of layer 76 so that conical section 70 is formed by the application of layer 76 to tubular 68. In another specific embodiment, conical section 70 could be a tubular sleeve of a more wear resistant material than tubular 68, flex-joint 56, or upper mill 60. The tubular sleeve is the disposed around cylindrical tubular 68, flex-joint 56, or upper mill 60.

Although the outer surface of conical section 70 may include one or more layers 76 to reduce wear of conical section 70, it is to be understood that conical section 70 is not abrasive as it is not intended to cut or abrade, or otherwise provide any milling of, the wellbore casing. To the contrary, conical section 70 is a non-cutting portion of casing window milling assembly 50.

Figure 5:
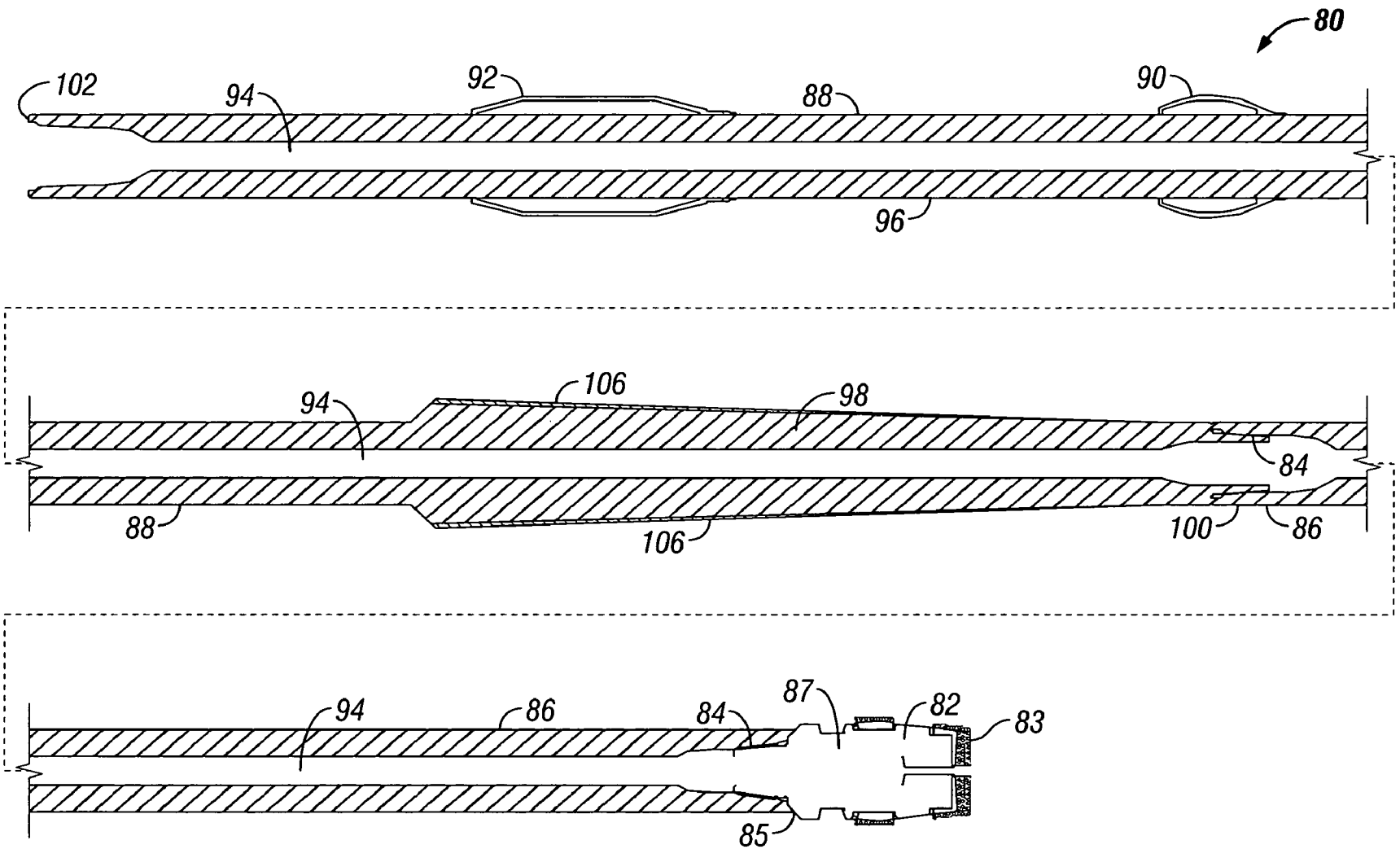
FIG. 5 is a cross-sectional view of an additional specific embodiment of the casing window milling assembly disclosed herein.

Referring now to FIG. 5, in an additional specific embodiment, casing window milling assembly 80 includes mill head 82 secured, such as through threads 84, to flex-joint 86. Flex-joint 86 is secured, such as through threads 84, to upper mill 88. Upper mill 88 includes one or both of reaming mill 90 honing mill 92. Bore 94 is longitudinally disposed through mill head 82, flex-joint 86, and upper mill 88.

In this embodiment, upper mill 88 includes tubular 96 having conical section 98 disposed along a length of tubular 96. Thus, in this embodiment, conical section 98 is formed on upper mill 88, rather than on a separate sub-assembly (FIG. 2) or on the flex-joint (FIG. 4). As shown in FIG. 5, preferably, conical section 98 of upper mill 88 is disposed between the upper end of flex-joint 86 and reaming mill 90 and honing mill 92.

Conical section 98 has a variable outer diameter, such that conical section 98 and, thus, tubular 96, is at least partially conically-shaped. The narrower outer diameter of conical section 98 is disposed proximate to lower end 100 of upper mill 88 and the wider outer diameter of conical section 98 is disposed proximate to upper end 102 of upper mill 88. Preferably, conical section 98 is disposed closer to lower end 100 than to upper end 102. Also preferably, the length of conical section 98, i.e., the conically shaped section of tubular 96, is at least one-quarter the total length of upper mill 88, thereby providing prolonged contact of conical section 98 with the inner wall surface of the wellbore casing. In a particularly preferred embodiment, the length of conical section 98 that is conically shaped is at least two times the length of mill head 82, where mill head 82 is measured from its lower end 83 to the top 85 of mill head housing or body 87, i.e., at the bottom of threads 84. The length and variable diameters of conical section 70 may also include any of the dimensions discussed above with respect to the embodiments shown in FIGS. 2-4.

Tubular 96 and, thus conical section 98, may be formed out of any material known to persons of ordinary skill in the art. Preferably, suitable conical section 98 is formed out of a material that is wear-resistant such that conical section 98 is not easily worn down by contact with the inner wall surface of the wellbore casing. In specific embodiments, conical section 98 comprises an outer coating or layer 106 of hardened material, such as aluminum bronze, tungsten carbide or hardfacing, to reduce wear along the outer surface of conical section 98 during milling of a window in the wellbore casing. Alternatively, conical section 98 could be homogeneous material machined to form tubular 96 having a conically shaped exterior. In a preferred embodiment, conical section 98 comprises layer 106 of aluminum bronze, tungsten carbide or hardfacing is applied to the outer surface of conical section 98. Layer 106 can be applied to the cylindrical outer diameter of tubular 68 in such a way that the upper end of layer 106 is thicker than the lower end of layer 106 so that conical section 98 is formed by the application of layer 106 to tubular 96. In another specific embodiment, conical section 98 could be a tubular sleeve of a more wear resistant material than tubular 96, flex-joint 86, or upper mill 88. The tubular sleeve is the disposed around cylindrical tubular 68, flex-joint 86, or upper mill 88.

Although the outer surface of conical section 98 may include one or more layers 106 to reduce wear of conical section 98, it is to be understood that conical section 70 is not abrasive as it is not intended to cut or abrade, or otherwise provide any milling of, the wellbore casing. To the contrary, conical section 98 is a non-cutting portion of casing window milling assembly 80.

In general, casing window milling assemblies 20, 50, and 80 all operated in substantially the same way. For purposes of simplicity, the following description of the operation of casing window milling assemblies 20, 50, and 80 will be described with respect to casing window milling assembly 20 (FIGS. 2-3).

Once assembled, casing window milling assembly 20 is lowered into a cased wellbore 53 (FIG. 3) until mill head 22 contacts whipstock 51. Alternatively, whipstock 51 can be included as part of the casing window milling assembly so that whipstock 51 can be set during a single run of casing window milling assembly 20 into cased wellbore 53. Such an arrangement is well known to persons of ordinary skill in the art. Likewise, whipstocks are known to persons of ordinary skill in the art.

Whipstock 51 guides mill head 22 into the wellbore casing to facilitate mill head 22 cutting a window in the wellbore casing. As casing window milling assembly 20 is lowered downward, mill head 22 is rotated and begins cutting casing 53. As casing window milling assembly 20 is lowered further into casing 53, conical section 43 engages casing 53 and is pressed or pinned between casing 53 and whipstock 51 as shown in FIG. 3, thereby providing stability to mill head 22. In preferred embodiment, angle 45 of conical section 43 between the upper and lower ends of conical section 43 is equal to tapered angle 49 of whipstock 51 so that conical section 43 is in contact along substantially its entire length with both whipstock 51 and the inner wall surface of casing 53. As a result, reaming mill 32 and honing mill 34 are restricted from prematurely contacting casing 53 due to reduced bouncing. Moreover, reaming mill 32 and honing mill 34 are less likely to lose their cutting ability before the complete window is cut in the wellbore casing 53.

In another preferred embodiment, conical section 43 is shaped so that the upper end of conical section 43 contacts whipstock 51 and the inner wall surface of casing 53. In this embodiment, mill head 22 is stabilized, but the remaining length, including the lower end, of conical section 43 does not contact both whipstock 51 and the inner wall surface of casing 53.

As casing window milling assembly 20 is further lowered downward through casing 53, reaming mill 32 and honing mill 34 contact casing 53 and begin cutting casing 53. Preferably, one or both reaming mill 32 or honing mill 34 contact casing 53 when mill head 22 is approximately past half-way down the length of whipstock 51 and the reaming mill 32 is approximately 4 feet above whipstock 51.

Casing window milling assembly 20 continues to be lowered causing mill head 22 to continue to cut the casing 53. Mill head 22 cuts through casing 53 and moves into the earth formation to form an open-hole wellbore (not shown). After mill head 22 has drilled into casing 53 a sufficient distance, reaming mill 32 and honing mill 34 begin to contact and cut the casing 53. As mill head 22, reaming mill 32, and honing mill 34 continue to cut wellbore casing 53, conical section 43 continues to stabilize casing window milling assembly 20 as illustrated in FIG. 3, thereby reducing vibration of mill head 22.

Cutting of casing 53 continues in this manner until the portions of casing 53 cut by reaming mill 32 and honing mill 34 contact the window in casing 53 cut by mill head 22. Once this is accomplished casing window milling assembly 20 can be retrieved from the wellbore casing and a drill string or another piece of equipment can be run into the wellbore casing to complete the new wellbore.

It is to be understood that the invention is not limited to the exact details of construction, operation, exact materials, or embodiments shown and described, as modifications and equivalents will be apparent to one skilled in the art. Accordingly, the invention is therefore to be limited only by the scope of the appended claims.

What is claimed is:

1. An improved casing window milling assembly having a tubular and a mill head disposed at a lower end of the tubular, the improvement comprising:

a conically shaped section of the tubular that is tapered toward the mill head, the conically shaped section comprising an upper portion and a lower portion, the upper portion having an outer diameter greater than an outer diameter of the lower portion, and an outer layer disposed along an outer surface of the conically shaped section, the outer layer comprising a wear resistant, nonabrasive, material, wherein the outer diameter of the upper portion is sized to cause engagement of the upper portion with a whipstock surface of a whipstock disposed in a wellbore at a non-parallel angle relative to a longitudinal axis of the whipstock.

2. The improved casing window milling assembly of claim 1, wherein the conically shaped section of the tubular is at least twice as long as a largest outer diameter of the conically shaped section.

3. The improved casing window milling assembly of claim 1, wherein the assembly further comprises a whipstock having a whipstock taper angle and wherein the conically shaped section has a taper angle that is equal to one-half of the whipstock taper angle.

4. The improved casing window milling assembly of claim 1, wherein the assembly further comprises a flex portion between the conically shaped section and the mill head.

5. The improved casing window milling assembly of claim 1, wherein the conically shaped section is formed of a material having a hardness greater than the tubular.

6. The improved casing window milling assembly of claim 1, wherein the outer layer comprises hardfacing.

7. The improved casing window milling assembly of claim 1, wherein the assembly further comprises a secondary mill and the conically shaped section is disposed between the mill head and the secondary mill.

8. A casing window milling assembly comprising:

a mill head having a mill housing, a cutting end, a mill head upper end, and mill head bore longitudinally disposed within the mill housing;

a flex-joint having a flex-joint tubular, a flex-joint lower end connected to the mill head upper end, a flex-joint upper end, and a flex-joint bore longitudinally disposed within the flex-joint tubular and in fluid communication with the mill head bore, wherein at least a portion of the flex-joint tubular is a conically shaped section that is tapered toward the mill heads, the conically shaped section comprising an upper portion and a lower portion, the upper portion having an outer diameter greater than an outer diameter of the lower portion, and an outer layer disposed along an outer surface of the conically shaped section, the outer layer comprising a wear resistant, nonabrasive, material, wherein the outer diameter of the upper portion is sized to cause engagement of the upper portion with a whipstock surface of a whipstock disposed in a wellbore at a non-parallel angle relative to a longitudinal axis of the whipstock; and an upper mill having an upper mill tubular, an upper mill lower end connected to the flex-joint upper end, an upper mill upper end, an upper mill bore longitudinally disposed within the upper mill tubular and in fluid communication with the flex-joint bore, and at least one secondary upper mill disposed along the upper mill tubular.

9. The casing window milling assembly of claim 8, wherein the conically shaped section of the flex-joint tubular is disposed proximate to the flex-joint upper end.

10. The casing window milling assembly of claim 8, wherein the conically shaped section of the flex-joint tubular is at least twice as long as a largest outer diameter of the flex-joint tubular.

11. The casing window milling assembly of claim 8, wherein the flex-joint has a length and the conically shaped section of the flex-joint tubular has a conically shaped section length that is at least one third of the length of the flex-joint.

12. The casing window milling assembly of claim 8, wherein the conically shaped section of the flex-joint tubular is formed from a material selected from the group consisting of aluminum bronze, tungsten carbide, or hardfacing.

13. The casing window milling assembly of claim 8, wherein the outer layer is formed from a material selected from the group consisting of aluminum bronze, tungsten carbide, or hardfacing.

14. A casing window milling assembly comprising:

a mill head having a mill housing, a cutting end, a mill head upper end, and mill head bore longitudinally disposed within the mill housing;

a flex-joint having a flex-joint tubular, a flex-joint lower end connected to the mill head upper end, a flex-joint upper end, and a flex-joint bore longitudinally disposed within the flex-joint tubular and in fluid communication with the mill head bore; and an upper mill having an upper mill tubular, an upper mill lower end connected to the flex-joint upper end, an upper mill upper end, an upper mill bore longitudinally disposed within the upper mill tubular and in fluid communication with the flex-joint bore, and at least one secondary upper mill disposed along the upper mill tubular, wherein at least a portion of the upper mill tubular is a conically shaped section that is tapered toward the mill heads, the conically shaped section comprising an upper portion and a lower portion, the upper portion having an outer diameter greater than an outer diameter of the lower portion, and an outer layer disposed along an outer surface of the conically shaped section, the outer layer comprising a wear resistant, nonabrasive, material, wherein the outer diameter of the upper portion is sized to cause engagement of the upper portion with a whipstock surface of a whipstock disposed in a wellbore at a non-parallel angle relative to a longitudinal axis of the whipstock.

15. The casing window milling assembly of claim 14, wherein at least one of the at least one secondary upper mills is disposed above the conically shaped section of the upper mill tubular.

16. The casing window milling assembly of claim 14, wherein the upper mill tubular includes two secondary upper mills, both of the secondary upper mills being disposed above the conically shaped section of the upper mill tubular.

17. The casing window milling assembly of claim 14, wherein the conically shaped section of the upper mill is disposed proximate to the upper mill lower end.

18. The casing window milling assembly of claim 14, wherein the conically shaped section of the upper mill tubular is formed from a material selected from the group consisting of aluminum bronze, tungsten carbide, or hardfacing.

19. The casing window milling assembly of claim 14, wherein the outer layer is formed from a material selected from the group consisting of aluminum bronze, tungsten carbide, or hardfacing.

20. A casing window milling assembly comprising:

a mill head having a mill housing, a cutting end, a mill head upper end, and mill head bore longitudinally disposed within the mill housing;

a flex-joint having a flex-joint tubular, a flex-joint lower end connected to the mill head upper end, a flex-joint upper end, and a flex-joint bore longitudinally disposed within the flex-joint tubular and in fluid communication with the mill head bore;

a tapered sub having a tapered sub tubular, a tapered sub lower end connected to the flex-joint upper end, a tapered sub upper end, and a tapered sub bore longitudinally disposed within the tapered sub tubular, wherein at least a portion of the tapered sub tubular is a conically shaped section that is tapered toward the mill head, the conically shaped section comprising an upper portion and a lower portion, the upper portion having an outer diameter greater than an outer diameter of the lower portion, and an outer layer disposed along an outer surface of the conically shaped section, the outer layer comprising a wear resistant, nonabrasive, material, wherein the outer diameter of the upper portion is sized to cause engagement of the upper portion with a whipstock surface of a whipstock disposed in a wellbore at a non-parallel angle relative to a longitudinal axis of the whipstock; and an upper mill having an upper mill tubular, an upper mill lower end connected to the tapered sub upper end, an upper mill upper end, an upper mill bore longitudinally disposed within the upper mill tubular and in fluid communication with the tapered sub bore, and at least one secondary upper mill disposed along the upper mill tubular.

21. The casing window milling assembly of claim 20, wherein the conically shaped section of the tapered sub constitutes a majority of the length of the tapered sub.

22. The casing window milling assembly of claim 20, wherein the conically shaped section of the tapered sub tubular is at least twice as long as a length of the mill head as measured from a lower most point of the cutting end to an upper most point of the mill tubular.

23. The casing window milling assembly of claim 20, wherein the conically shaped section of the tapered sub tubular is formed from a material selected from the group consisting of aluminum bronze, tungsten carbide, or hardfacing.

24. The casing window milling assembly of claim 20, wherein the outer layer is formed from a material selected from the group consisting of aluminum bronze, tungsten carbide, or hardfacing.

25. A method of cutting a window in a casing disposed in a wellbore to form a lateral wellbore disposed at a non-parallel angle relative to the cased wellbore, the method comprising the steps of:

(a) providing a longitudinal cased wellbore having a whipstock disposed therein, the whipstock comprising a longitudinal axis;

(b) assembling a casing window milling assembly, the casing window milling assembly comprising a tubular and a mill head having a cutting end disposed at a lower end of the tubular, the tubular comprising a conically shaped section that is tapered toward the mill head, the conically shaped section comprising an upper portion and a lower portion, the upper portion having an outer diameter greater than an outer diameter of the lower portion, and an outer layer disposed along an outer surface of the conically shaped section, the outer layer comprising a wear resistant, nonabrasive, material;

(c) disposing the casing window milling assembly in the casing of the wellbore;

(d) guiding the casing window milling assembly along the whipstock disposed within the casing of the wellbore;

(e) engaging the cutting end of the casing window milling assembly with the casing of the wellbore causing the cuffing end to facilitate the cuffing of a window in the casing while the casing window milling assembly is moved down the whipstock;

(f) while the casing window milling assembly is moved down the whipstock, flexing a portion of the tubular causing the upper portion of the conically shaped section of the casing window milling assembly to engage the whipstock at an angle that is non-parallel to the longitudinal axis of the casing; and (g) continuing to move the casing window milling assembly down the whipstock without cuffing the whipstock with the upper portion of the conically shaped section of the casing window milling assembly engaged with the whipstock at the angle that is non-parallel to the longitudinal axis of the casing until the window is cut by the cuffing end.

26. The method of claim 25, wherein during step (f), a portion of the conically shaped section also engages an inner wall surface of the casing above the whipstock.

* * * * *